US008375609B2

(12) United States Patent
Harrington

(10) Patent No.: US 8,375,609 B2
(45) Date of Patent: Feb. 19, 2013

(54) IRON WITH LIP FOR IRONING HARD TO REACH AREAS ON A GARMENT

(75) Inventor: John Harrington, Deerfield Beach, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 175 days.

(21) Appl. No.: 12/913,916

(22) Filed: Oct. 28, 2010

(65) Prior Publication Data

US 2012/0102793 A1 May 3, 2012

(51) Int. Cl.
*D06F 75/38* (2006.01)
*D06F 75/18* (2006.01)

(52) U.S. Cl. ..... 38/77.83; 38/93

(58) Field of Classification Search ..... 132/269; 38/77.83, 88, 93
See application file for complete search history.

(56) References Cited

U.S. PATENT DOCUMENTS 2,601,059 A 6/1952 Rotheraine
3,068,598 A * 12/1962 Johnston ..... 38/71
3,449,846 A 6/1969 Bricker
3,577,859 A 5/1971 Davidson
3,703,042 A * 11/1972 Smith ..... 38/69
3,811,208 A 5/1974 Vieceli et al.
D247,544 S 3/1978 Gustavsson
4,219,724 A 8/1980 Allvin
4,817,309 A 4/1989 Frank et al.
RE38,713 E 3/2005 Habibi
7,121,024 B1 10/2006 Clevenberg
7,188,442 B2 3/2007 Fernandez
D551,388 S 9/2007 Kuchler et al.
7,380,556 B2 6/2008 Carballada et al.
2002/0190047 A1* 12/2002 Nam ..... 219/222
2009/0260651 A1* 10/2009 Chan ..... 132/269
2010/0192427 A1* 8/2010 Bearley ..... 38/77.8

* cited by examiner

*Primary Examiner* — Ismael Izaguirre
(74) *Attorney, Agent, or Firm* — Michael J. Corrigan

(57) ABSTRACT

A portable, handheld iron (10) is provided having a pair of opposing soleplates (25, 35) with a lip (26, 36) for reaching hard to reach areas on a garment. The soleplates (25, 35) are disposed on respective upper and lower portions (20, 30) pivotally connected by a hinge (40). The upper and lower portions (20, 30) are moveable between open and closed positions. The longitudinal axes B of the upper and lower portions (20, 30) are offset from the plane of the soleplates (25, 35) by an offset angle α when in the closed position. The offset angle α provides the iron (10) with an ergonomic advantage in reaching hard to reach areas. In an embodiment, at least one of the soleplates (25, 35) is provided with a plurality of vents (27) for delivering wrinkle releasing steam.

18 Claims, 4 Drawing Sheets

IRON WITH LIP FOR IRONING HARD TO REACH AREAS ON A GARMENT

FIELD OF THE INVENTION

The present invention generally relates to irons, and more particularly to an iron for quick garment touch ups and having a lip for ironing hard to reach areas on the garment.

BACKGROUND OF THE INVENTION

There exists in the art irons for pressing garments. Typically, with conventional irons a garment is placed on a horizontal surface and the garment is pressed on a single side. These irons may include a button lip which allows for pressing the garment in hard to reach areas such as around buttons. However, these irons suffer from the drawbacks of not being portable, are too heavy to lift for pressing a hanging garment and require an ironing board, can only press one side of the garment, and the size and shape of the soleplate may prevent it from reaching hard to reach areas.

There also exists in the art portable, handheld irons for pressing hanging garments. These irons may also suffer from the drawbacks of the soleplate being sized and shaped improperly to reach hard to reach areas, may not have a button lip for reaching the hard to reach areas, and can't press both sides of the garment.

Accordingly, there exists a need for a portable, handheld iron for quick touch ups that is lightweight, convenient and easy to use, allows clothes to be ironed while still on the clothes hanger without the need for an ironing board, has soleplates that are not too large or improperly shaped to reach hard to get areas, has a button lip for reaching hard to reach areas, can iron both sides of the garment at the same time, and can be converted while traveling to an iron having a single soleplate for ironing in a more conventional manner.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

A portable iron is provided having a lip for ironing hard to reach areas on a garment such as around buttons.

Figure 1:
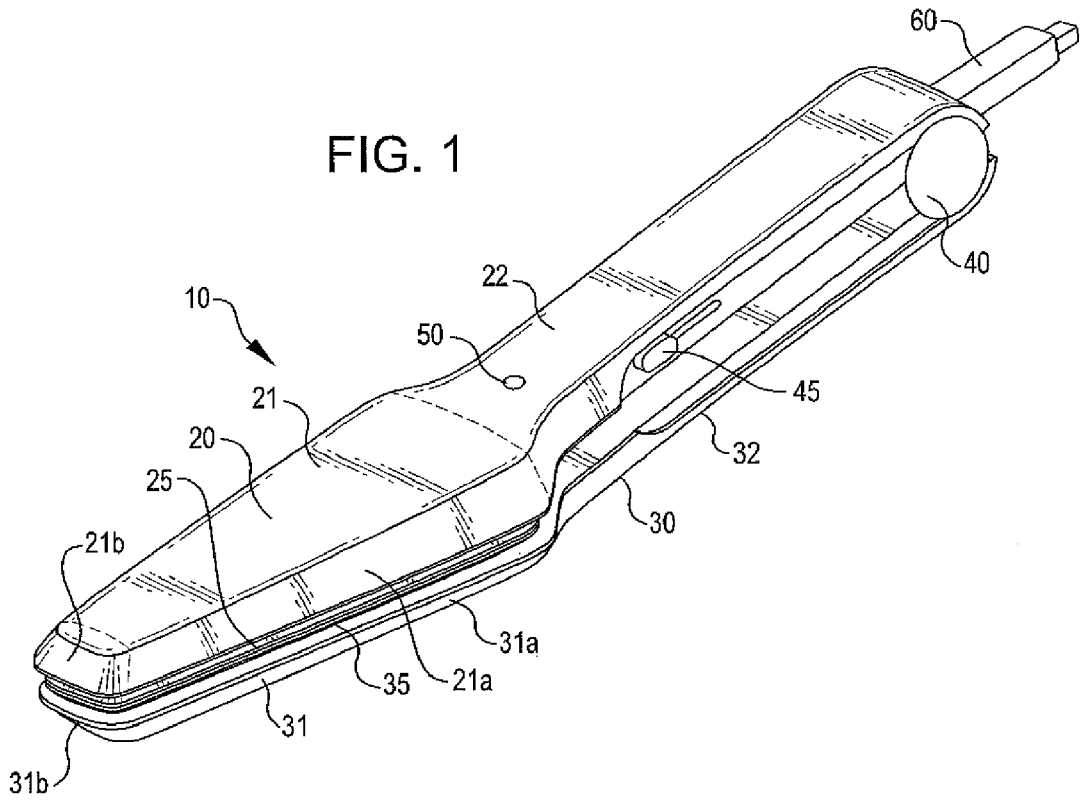
FIG. 1 depicts a perspective view of an embodiment of a portable iron where an upper and lower portion are in a closed configuration.
Figure 2:
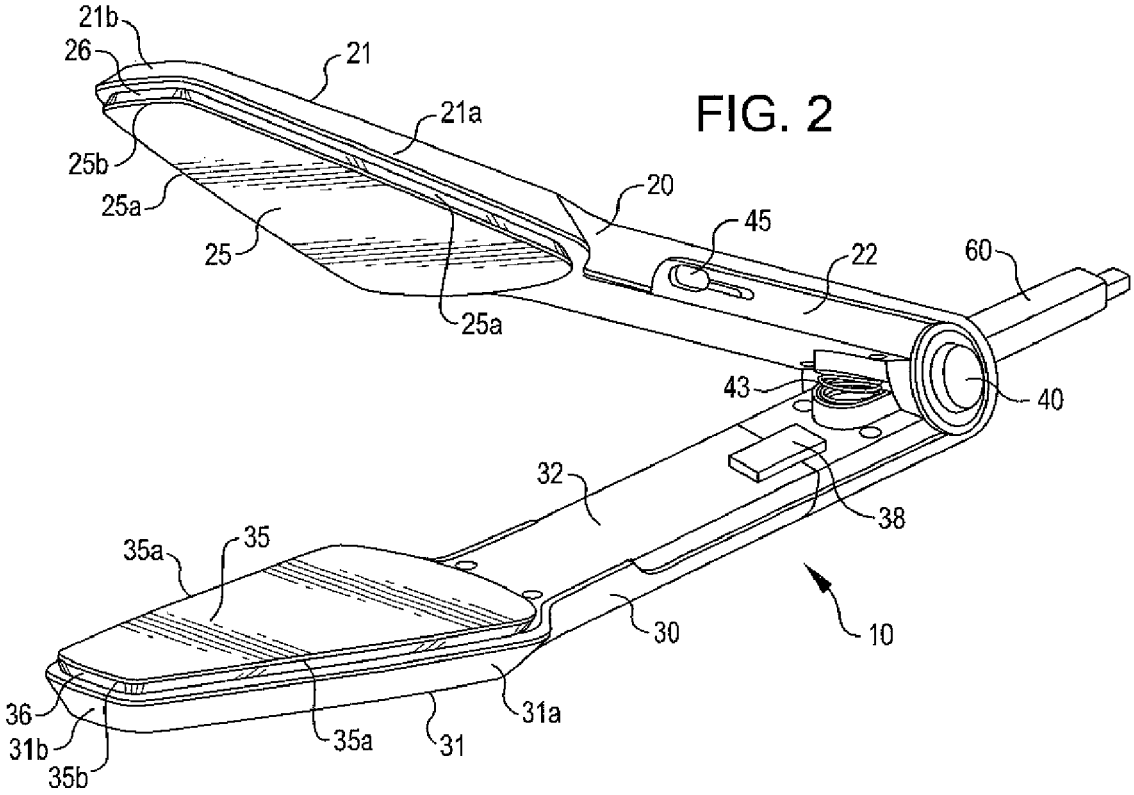
FIG. 2 depicts another perspective view of the portable iron shown in FIG. 1 where the upper and lower portions are in an open configuration.

Referring now to the drawing figures in which like reference designators refer to like elements, there is shown in FIGS. 1 and 2 an embodiment of a portable iron 10 in a first or fully assembled configuration having a button lip for ironing hard to reach areas such as around buttons. It should be understood that this embodiment is not meant to be limiting as there may be other embodiments of irons known to one of ordinary skill in the art that may include such a lip for reaching hard to get areas.

In the illustrated embodiment, the iron 10 includes a pair of opposing heated soleplates 25, 35 on an upper portion 20 and lower portion 30, respectively. The upper portion 20 and lower portion 30 are hingedly connected together at a hinge 40. The soleplates 25, 35 are suitably sized and shaped to maximize the heated surface area yet allow the soleplates 25, 35 to reach hard to reach areas. For example, the soleplates 25, 35 may be triangular-shaped and include tapered sides 25*a*, 35*a* that meet at respective relatively short ends 25*b*, 35*b*. As such, the tapered sides 25*a*, 35*a* and ends 25*b*, 35*b* allow portions of the soleplates 25, 35 to reach areas that are normally hard to reach when ironing such as around and between buttons, collars and pockets. In addition, the soleplates 25, 35 may include a lip or edge 26, 36 (see also FIGS. 4 and 5), respectively, surrounding the periphery but not exceeding the respective housing portions 21, 31 the soleplates 25, 35 are attached to. The lip or edge 26, 36 is a space between the housing portions 21, 31 and the edge of the soleplates 25, 35. The lip 26, 36 further aids in ironing hard to reach areas such as around buttons, in pockets and collars as described below.

In addition, the housing portions 21, 31 may respectively include opposing tapered sides 21*a*, 31*a* that are parallel to the tapered sides 25*a*, 35*a* of the soleplates 25, 35. The tapered sides 21*a*, 31*a* of the housing portions 21, 31 may likewise meet at respective short ends 21*b*, 31*b* that are parallel to respective short ends 25*b*, 35*b* of the soleplates 25, 35.

The iron 10 may be used as a handheld iron where a fabric of a garment is inserted into a space between the heated opposing soleplates 25, 35 for pressing the fabric. The upper and lower portions 20, 30 are pivotally connected together with a hinge 40 to allow the fabric to be inserted between the soleplates 25, 35. The upper and lower portions 20, 30 may be biased by a spring 43 in an open or normal position. In use, the upper and lower portions 20, 30 are urged or squeezed together such that the space there between is minimized and the fabric is grasped between the opposing heated soleplates 25, 35 (FIG. 1). Such an arrangement proves to be very useful when ironing a garment such as a hanging garment. When the upper and lower portions 20, 30 are released, the fabric may be released from the heated opposing soleplates 25, 35.

In an embodiment, at least one of the soleplates 25, 35 may be attached to the respective upper and lower portions 20, 30 via a spring arrangement (not shown). This allows the soleplates 25, 35 to be essentially spring-loaded and more effectively grasp the fabric when the upper and lower portions 20, 30 are urged or squeezed together.

In an embodiment, the hinge 40 may be a locking hinge that only allows the upper and lower portions 20, 30 to rotate relative to one another in a predetermined arc of rotation. For example, the predetermined arc of rotation may be from an angle of 30° between the upper and lower portions 20, 30 in the open or normal position to an angle of near 0° in the closed or ironing position. It should be understood that this is an exemplary embodiment only and not meant to be limiting as there may be other embodiments of the arc of rotation of the upper and lower portions 20, 30 relative to one another that are suitable.

In an embodiment, the pair of opposing soleplates 25, 35 are heated by heating elements (not shown) disposed between the respective soleplates 25, 35 and the housing portions 21, 31 they are attached to. The heating elements (not shown) are provided electrical power from an electrical cord 60 disposed to the rear of the iron 10. The electrical cord 60 may be connected to a source of power such as a conventional 110 vac source or other source. An electrical switch 45 that may be a variable switch such as a slide or rotary switch may be provided to control the electrical power from the cord 60 to the heating elements (not shown). An indicator 50 such as a lighted indicator may be provided on the upper portion 20 to indicate when the power is being provide to the heating elements (not shown). The operation of the heating elements (not shown), electrical controls such as switch 45, the lighted indicator 50, and the use of the electrical cord 60 for providing power from a source in an appliance such as an iron are known in the art and require no further discussion.

In another embodiment, only the upper soleplate 25 is heated by a heating element (not shown). In another embodiment, only the lower soleplate 3 is heated by a heating element (not shown).

Figure 3:
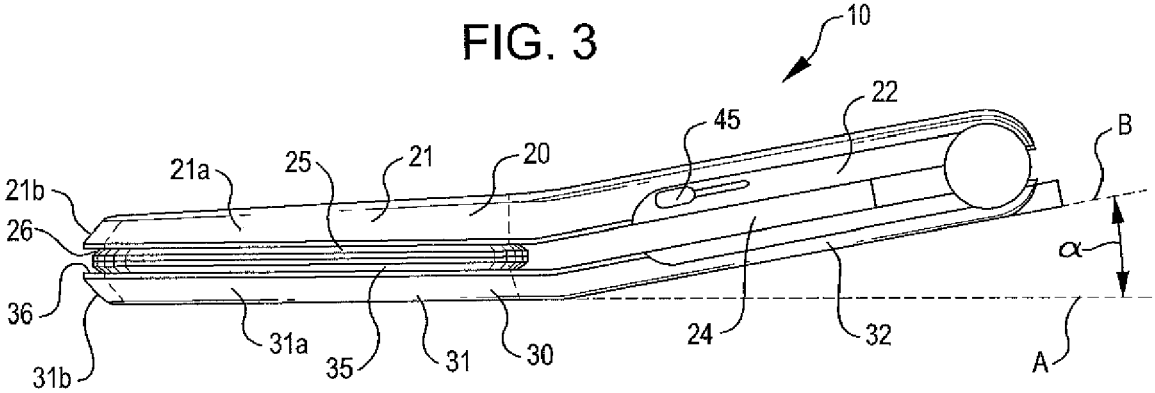
FIG. 3 depicts a right side view of the portable iron of FIG. 1.

Referring now to FIG. 3, in an embodiment the upper and lower portions 20, 30 may include angled portions 22, 32 that have longitudinal axes B that are offset an angle $\alpha$ such as 10° from a plane A that is parallel to the respective soleplates 25, 35. The offset angle $\alpha$ provides an ergonomic advantage to the user when holding the iron 10 when pressing a garment such as a hanging garment. The offset angle $\alpha$ advantageously allows the user to position the soleplates 25, 35 into areas on a garment that are normally hard to reach with conventional irons. It should be understood that the foregoing offset angle $\alpha$ of 10° is not meant to be limiting as there may be other offset angles $\alpha$ that may be desirable to provide an ergonomic advantage to the user when holding the iron 10 and pressing a garment.

In an embodiment, the iron 10 may include a slot 24 that is formed in an underside of the upper portion 20. The slot 24 is adjacent to the opposing soleplates 25, 35 and disposed between the soleplates 25, 35 and the hinge 40. The slot 24 is for receiving fabric and aids in maneuvering the soleplates 25, 35 into hard to reach areas such as around buttons while preventing the upper and lower portions 20, 30 from grabbing the garment.

Figure 4:
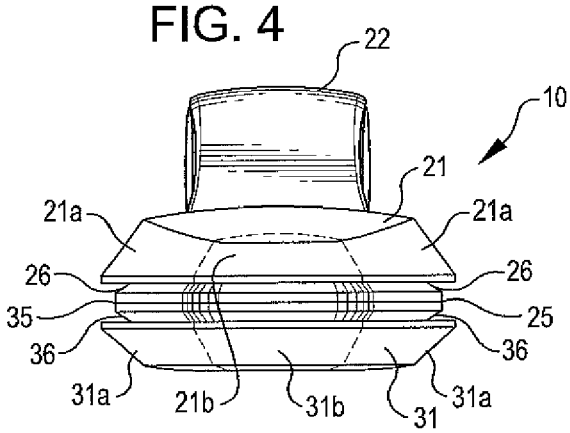
FIG. 4 depicts a front view of the portable iron of FIG. 1.
Figure 5:
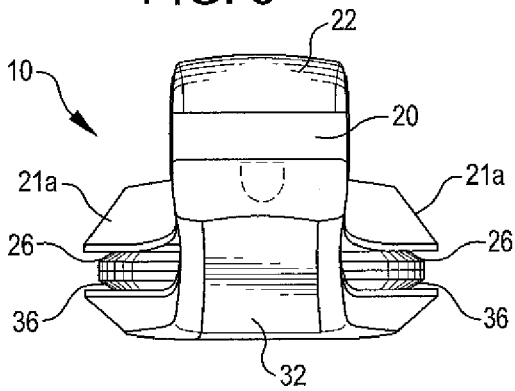
FIG. 5 depicts a rear view of the portable iron of FIG. 1.

Referring now also to FIGS. 4 and 5, as previously discussed above, each of the heated opposing soleplates 25, 35 have a button lip or edge 26, 36, respectively, surrounding the periphery but not exceeding the respective housing portions 21, 31 the soleplates 25, 35 are attached to. The button lips 26, 36 are a space between the outer edges of the soleplates 25, 35 and the adjacent surface of the respective housings 21, 31. This space allows a button to be substantially received therein allowing the soleplates 25, 35 to penetrate into the area on the garment beneath the button. The button lips 26, 36 provide the user with the additional benefit that the full heating surfaces of the soleplates 25, 35 may be used for faster ironing while the iron 10 may be laid on its side without worry that the surface on which it is laid will be burned.

Figure 6:
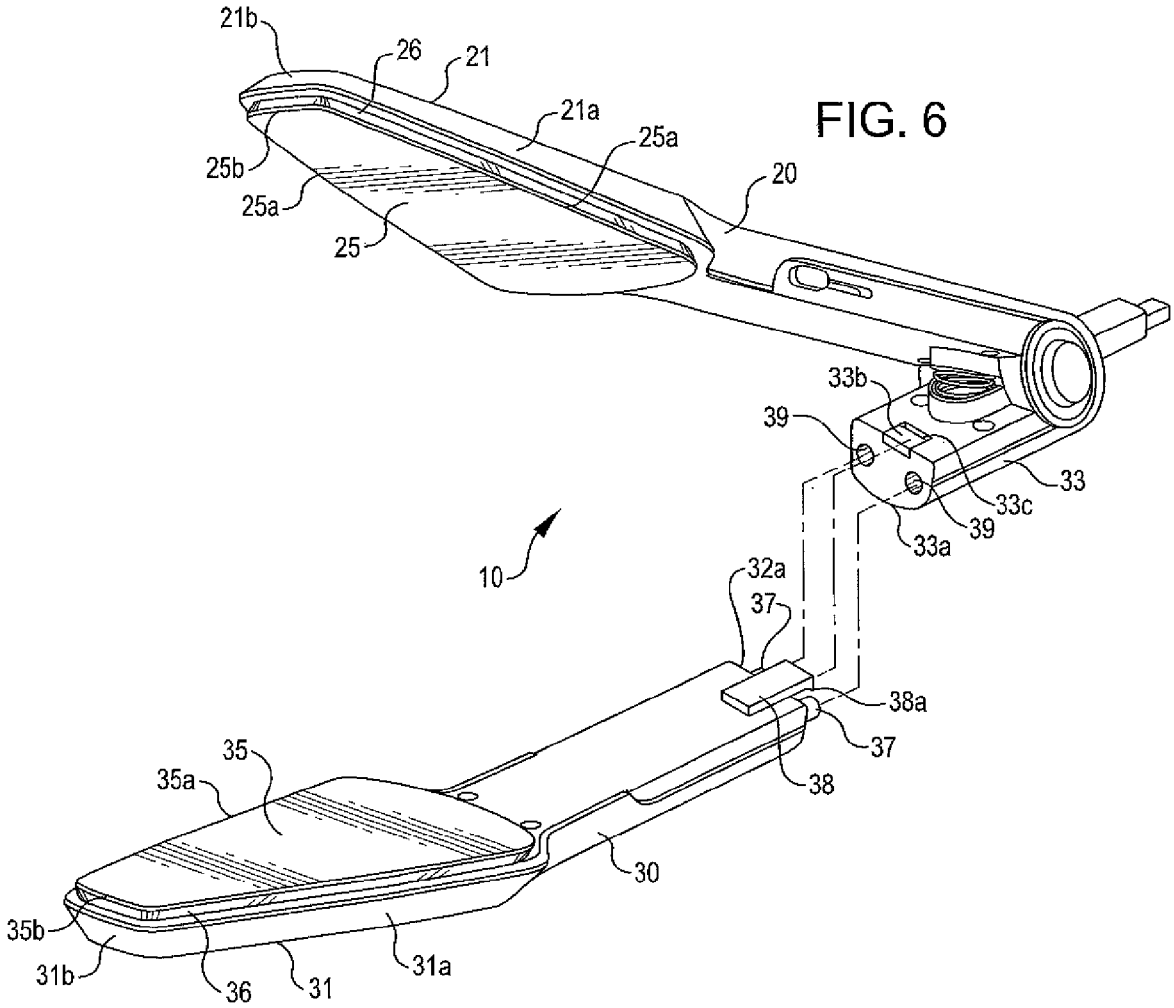
FIG. 6 depicts a perspective of the portable iron of FIG. 1 in a detached configuration.

Referring now to FIG. 6, in an embodiment there is provided an iron 10 in a second or detached configuration. In the illustrated embodiment, the lower portion 30 may be detached from the upper portion 20 such that the iron 10 may be used as a "flat" iron. In other words, in this configuration the iron 10 may be used as more of a conventional iron with a single heated soleplate 25 used to press a garment against a flat horizontal surface such as an ironing board or a vertical surface.

To enable the lower portion 30 of the iron 10 to be detached from the upper portion 20, the angled portion 32 of the lower portion 30 may include quick disconnect electrical connectors 37 at an end 32*a*. In an embodiment, the electrical connectors 37 may include male electrical connectors. The end 32*a* of the angled portion 32 may be electrically connected to a hinged portion 33 of the lower portion 30 by inserting the electrical connectors 37 into complementary electrical connectors 39 disposed in an end 33*a* of the hinged portion 33. In the above embodiment, the electrical connectors 39 are female electrical connectors. When the hinged portion 33 is attached to the angled portion 32, the electrical connectors 37, 39 provide electrical power to the soleplate 35 via the switch 45 and electrical cord 60 as described above.

In an embodiment, the angled portion 32 may be secured to the hinged portion 33 via a latch 38 (see also FIG. 2) or other means for quickly attaching/detaching the angled/hinged portions 32, 33. The latch 38 may include an undulation 38*a* that engages a notch 33*c* in a recess 33*b* in the hinge portion 33 for securing the angled portion 32 to the hinged portion 33. To detach the lower portion 30 from the upper portion 20, the latch 38 is depressed and the undulation 38*a* is released from the notch 33*c* and the angled portion 32 may be separated from the hinged portion 33. The latch 38 may be biased by a spring (not shown) such that the undulation 38*a* is forced into the notch 33*c* for securing the angled portion 32 to the hinged portion 33.

Figure 7:
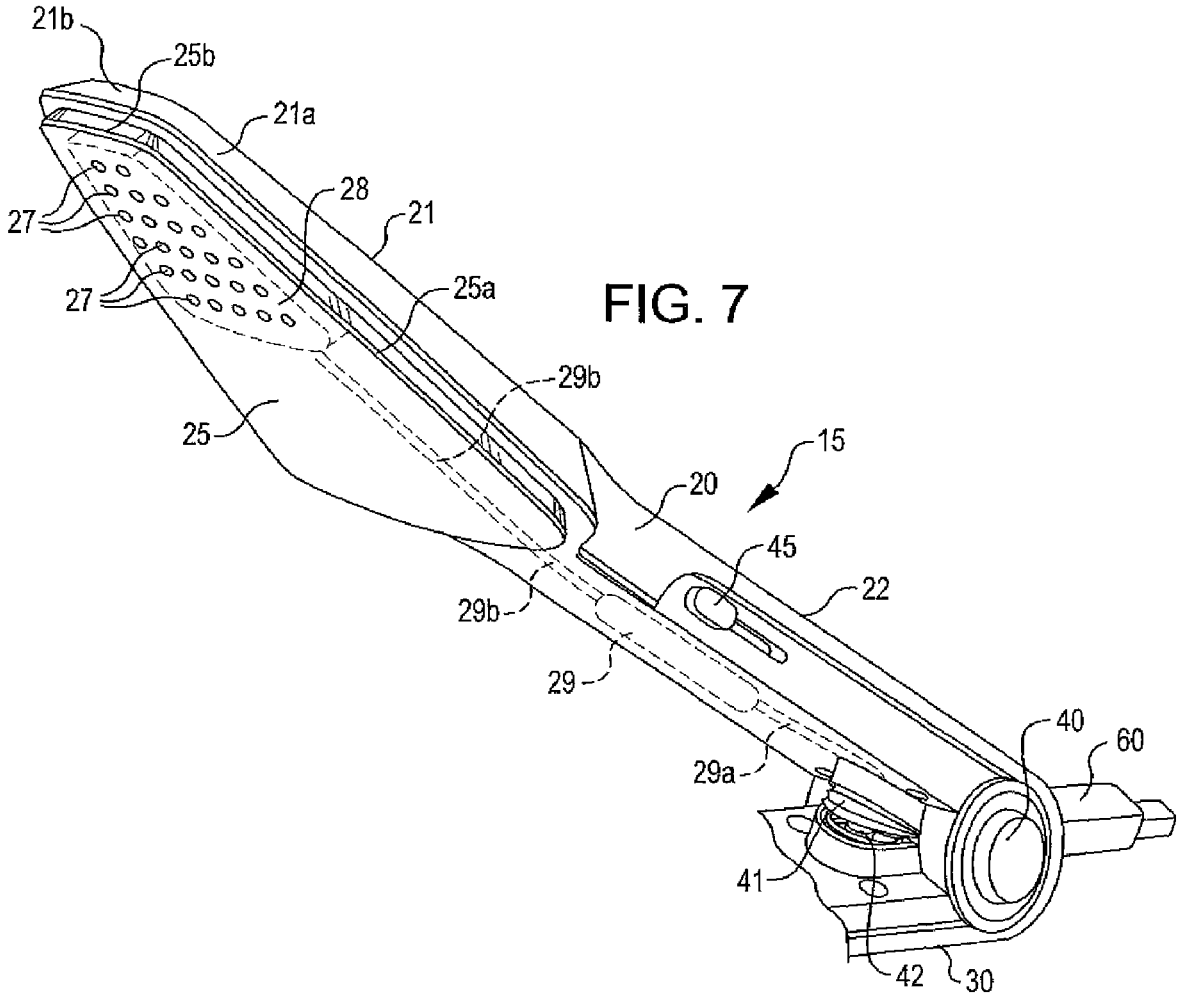
FIG. 7 depicts a perspective view of another embodiment of a portable iron.

Referring now to FIG. 7, another embodiment of a handheld iron 15 is illustrated similar to the embodiment of the iron 10 shown in FIGS. 1-6 and described above that includes a plurality of steam vents or holes 27 formed in at least one of the soleplates 25 or 35. In the embodiment shown, the plurality of vents 27 are formed in the soleplate 25 on the upper portion 20. The plurality of vents 27 are for delivering wrinkle releasing steam to a garment being pressed with the soleplate 25.

The steam is provided to the plurality of vents 27 from a steam chamber 28 disposed adjacent thereto. The steam chamber 28 generates steam with heat generated by a heating element (not shown) disposed in the housing portion 21 adjacent to the steam chamber 28. The steam chamber 28 is provided water for generating steam from a water tank 29 that may be disposed in the angled portion 22 of the upper portion 20. The water tank 29 is filled through an opening (not shown) with distilled water from a source. The steam chamber 28 is fluidly connected to the water tank 29 via a conduit 29*b*. The water is delivered to the steam chamber 28 from water tank 29 when the upper portion 20 and lower portion 30 are squeezed together when the garment is being pressed. Thus, wrinkle releasing steam is delivered to the garment through the plurality of vents 27.

A plunger 42 disposed in the hinge 40 depresses a bellows 41 that provides pressurized air to the water tank 29 via a conduit 29*a* when the upper and lower portions 20, 30 are squeezed together when pressing a garment. The pressurized air forces water from the water tank 29 through the conduit 29*b* into the steam chamber 28. When the water is heated in the steam chamber 28 and expands, it is forced out of the vents 27 as steam onto the garment below.

In another embodiment, there is a related method of pressing a garment, comprising inserting the garment into a space between a pair of opposing first and second soleplates 25, 35 disposed on respective upper and lower portions 20, 30 hingedly connected together, the upper and lower portions 20, 30 normally in a first position, and moving the upper and lower portions 20, 30 from the first position to a second position wherein the space between the first and second soleplates 25, 35 is minimized thereby pressing the garment between the first and second soleplates 25, 35.

The method further includes directing steam from a plurality of vents 27 in at least one of the soleplates 25, 35 onto the garment in the second position. The method further includes pumping water from a tank 29 to a chamber 28 disposed adjacent to at the at least one of the soleplates 25, 35 and generating steam therein. The water is pumped to the chamber 28 when the upper and lower portions 20, 30 are moved from the first position to the second position. The water is pumped to the chamber 28 by a bellows 41 disposed in a hinge 40 connecting the upper and lower portions 20, 30.

The method further includes providing a first housing portion 21 forming the upper portion 20 here the first soleplate 25 is disposed, providing a second housing portion 31 forming the lower portion 30 where the second soleplate 35 is disposed, forming a space 26 between an outer periphery of the first soleplate 25 and the first housing portion 21. The outer periphery of the first soleplate 25 does not extend completely to an edge of the first housing portion 21. The method further includes forming another space 36 between an outer periphery of the second soleplate 35 and the second housing portion 31. The outer periphery of the second soleplate 35 does not extend completely to an edge of the second housing portion 31.

The method further includes moving the upper and lower portions 20, 30 from the second position to the first position wherein the space between the first and second soleplates 25, 35 is maximized thereby allowing the garment between the first and second soleplates 25, 35 to be released.

The iron in the above disclosure has been described as a portable, handheld iron. However, it is contemplated that the soleplates and button lip, bladder, and plunger of the present disclosure can be utilized in other irons, including but not limited to conventional irons, and the like.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. An iron for pressing a garment, comprising:

an upper portion having a first soleplate disposed thereon;

a lower portion having a second soleplate disposed thereon;

a hinge pivotally connecting the upper and lower portions, wherein the upper portion and lower portions are moveable relative to one another about said hinge such that in a first position the garment is insertable between the first and second soleplates, and a second position where the garment is pressed between the respective first and second soleplates;

a plurality of vents formed in at least one of the first and second soleplates configured to deliver steam to the garment in the second position;

a steam chamber disposed adjacent to the plurality of vents where steam is generated for delivery to the garment through the plurality of vents;

a water tank in the respective upper or lower portions where the steam chamber is disposed for providing water to the steam chamber via a first conduit; and a plunger in the hinge which depresses a bladder disposed in the hinge when the upper and lower portions are moved to the second position which provides pressurized air via a second conduit to the water tank to pump water from the water tank to the steam chamber.

2. The iron of claim 1, further comprising:

a first housing portion forming the upper portion where the first soleplate is attached;

wherein an outer periphery of the first soleplate does not extend completely to an edge of the first housing portion and a space is formed between the outer periphery of the first soleplate and the first housing portion.

3. The iron of claim 1, further comprising:

a second housing portion forming the lower portion where the second soleplate is attached;

wherein an outer periphery of the second soleplate does not extend completely to an edge of the second housing portion and a space is formed between the outer periphery of the second soleplate and the second housing portion.

4. The iron of claim 1, further comprising:

a first housing portion forming the upper portion where the first soleplate is attached; and a second housing portion forming the lower portion where the second soleplate is attached;

wherein in a first configuration the lower portion is attached to the upper portion, and alternately, in a second configuration the lower portion is detached from the upper portion.

5. The iron of claim 4, wherein an outer periphery of the first soleplate does not extend completely to an edge of the first housing portion and a space is formed between the outer periphery of the first soleplate and the first housing portion, and an outer periphery of the second soleplate does not extend completely to an edge of the second housing portion and another space is formed between the outer periphery of the second soleplate and the second housing portion.

6. The iron of claim 1, wherein both the first and second soleplates are heated.

7. The iron of claim 1, further comprising:

a slot formed between the upper and lower portions that extends from the first and second soleplates to the hinge, said slot configured to receive a portion of the garment being pressed to enable the soleplates to reach hard to reach areas without grasping the portion of the garment.

8. The iron of claim 1, wherein said upper and lower portions respectively include angled portions having longitudinal axes that are offset from a plane of the first and second soleplates when in the second position by an angle $\alpha$.

9. The iron of claim 8, wherein the angle $\alpha$ is 10°.

10. A method of pressing a garment, comprising:

inserting the garment into a space on an iron between a pair of opposing first and second soleplates disposed on respective upper and lower portions hingedly connected together, the upper and lower portions normally in a first position;

moving the upper and lower portions from the first position to a second position wherein the space between the first and second soleplates is minimized thereby pressing the garment between the first and second soleplates;

directing steam from a plurality of vents in at least one of the soleplates onto the garment in the second position; and pumping water from a tank to a chamber disposed adjacent to at the at least one of the soleplates and generating steam therein;

wherein the water is pumped to the chamber when the upper and lower portions are moved from the first position to the second position.

11. The method of claim 10, wherein the water is pumped to the chamber by a bellows disposed in a hinge connecting the upper and lower portions.

12. The method of claim 10, further comprising:

providing a first housing portion forming the upper portion where the first soleplate is disposed;

providing a second housing portion forming the lower portion where the second soleplate is disposed;

forming a space between an outer periphery of the first soleplate and the first housing portion, wherein the outer periphery of the first soleplate does not extend completely to an edge of the first housing portion; and forming another space between an outer periphery of the second soleplate and the second housing portion, wherein the outer periphery of the second soleplate does not extend completely to an edge of the second housing portion.

13. The method of claim 10, further comprising:

moving the upper and lower portions from the second position to the first position wherein the space between the first and second soleplates is maximized thereby allowing the garment between the first and second soleplates to be released.

14. A convertible appliance, comprising:

a housing having an upper and lower portion;

a first soleplate portion including a first heating element attached to the upper housing portion; and a second soleplate portion including a second heating element attached to the lower housing portion;

wherein in a first configuration the lower housing portion is attached to the upper housing portion, and alternately, in a second configuration the lower housing portion is detached from the upper housing portion.

15. The convertible appliance of claim 14, further comprising a fastening means configured to removably secure the lower housing portion to the upper housing portion.

16. The convertible appliance of claim 15, wherein the fastening means includes prongs on the lower housing portion that are inserted into recesses in the upper housing portion.

17. The convertible appliance of 16, wherein the fastening means includes at least one of a catch, lock, or interference-type fit.

18. The convertible appliance of claim 14, further comprising:

a hinge pivotally connecting the upper and lower housing portions, wherein the upper housing and the lower housing portions are moveable relative to one another about said hinge such that in a first position the garment is insertable between the first and second soleplates, and a second position where the garment is pressed between the respective first and second soleplates;

a plurality of vents formed in at least one of the first and second soleplates configured to deliver steam to the garment in the second position;

a steam chamber disposed adjacent to the plurality of vents where steam is generated for delivery to the garment through the plurality of vents;

a water tank in the respective upper or lower housing portions where the steam chamber is disposed for providing water to the steam chamber via a first conduit; and a plunger in the hinge which depresses a bladder disposed in the hinge when the upper and lower housing portions are moved to the second position which provides pressurized air via a second conduit to the water tank to pump water from the water tank to the steam chamber.

* * * * *